US009382772B2

(12) United States Patent
Hart

(10) Patent No.: US 9,382,772 B2
(45) Date of Patent: Jul. 5, 2016

(54) SUBSEA TEST TREE INTERVENTION PACKAGE

(71) Applicant: OneSubsea IP UK Limited, London (GB)

(72) Inventor: Brian Hart, Wakefield (GB)

(73) Assignee: OneSubsea IP UK Limited, London (GB)

( * ) Notice: Subject to any disclaimer, the term of this patent is extended or adjusted under 35 U.S.C. 154(b) by 0 days.

(21) Appl. No.: 14/309,514

(22) Filed: Jun. 19, 2014

(65) Prior Publication Data

US 2015/0368998 A1 Dec. 24, 2015

(51) Int. Cl.

| | |
|---|---|
| ***E21B 7/12*** | (2006.01) |
| ***E21B 33/038*** | (2006.01) |
| ***E21B 17/01*** | (2006.01) |
| ***E21B 17/08*** | (2006.01) |
| ***E21B 17/10*** | (2006.01) |
| ***E21B 19/00*** | (2006.01) |

(52) U.S. Cl.

CPC ..... *E21B 33/038* (2013.01); *E21B 17/01* (2013.01); *E21B 17/085* (2013.01); *E21B 17/10* (2013.01); *E21B 19/002* (2013.01)

(58) Field of Classification Search

CPC ..... E21B 17/01; E21B 33/035; E21B 33/038; E21B 34/045

USPC ..... 166/345, 367, 368

See application file for complete search history.

(56) References Cited

U.S. PATENT DOCUMENTS

| | | | | | |
|---|---|---|---|---|---|
| 4,188,156 | A * | 2/1980 | Fisher et al. | 405/224.3 |
| 4,693,315 | A * | 9/1987 | Taylor | 166/336 |
| 5,960,885 | A * | 10/1999 | Edwards et al. | 166/345 |
| 6,053,252 | A * | 4/2000 | Edwards | 166/348 |
| 6,109,352 | A * | 8/2000 | Edwards et al. | 166/336 |
| 6,253,854 | B1 * | 7/2001 | Fenton | 166/364 |
| 6,343,654 | B1 * | 2/2002 | Brammer | 166/338 |
| 6,659,181 | B2 * | 12/2003 | Hartmann | 166/348 |
| 6,942,028 | B2 * | 9/2005 | Hosie | 166/88.4 |
| 7,114,571 | B2 | 10/2006 | Gatherar | |
| 7,121,346 | B2 * | 10/2006 | Wolff et al. | 166/348 |
| 7,240,734 | B2 * | 7/2007 | Nivens et al. | 166/339 |
| 8,297,359 | B2 | 10/2012 | McKay | |
| 8,322,441 | B2 * | 12/2012 | Fenton | 166/368 |
| 8,800,662 | B2 * | 8/2014 | Miller | 166/336 |
| 2003/0141071 | A1 * | 7/2003 | Hosie | 166/350 |
| 2006/0017287 | A1 * | 1/2006 | Milberger | 285/412 |
| 2007/0034379 | A1 * | 2/2007 | Fenton et al. | 166/368 |
| 2014/0311749 | A1 * | 10/2014 | Kongshem | 166/364 |
| 2015/0021035 | A1 * | 1/2015 | Miller | 166/348 |
| 2015/0068769 | A1 * | 3/2015 | Xiao et al. | 166/382 |

* cited by examiner

*Primary Examiner* — Matthew R Buck
*Assistant Examiner* — Aaron Lembo
(74) *Attorney, Agent, or Firm* — Chamberlain Hrdlicka

(57) ABSTRACT

A riser intervention system for use with a subsea test tree includes a lower riser package spool, an intermediate spool, and a riser stress joint. The lower riser package spool may include a bore and a shoulder projecting into the bore such that the subsea test tree is landable on the shoulder within the lower riser package spool. The intermediate spool is connectable to the lower riser package spool to secure the subsea test tree within the bore of the lower riser package spool such that the lower riser package spool is in fluid communication with the intermediate spool. The riser stress joint is releasably connectable to the intermediate spool using such that the intermediate spool is in fluid communication with the riser stress joint.

20 Claims, 3 Drawing Sheets

SUBSEA TEST TREE INTERVENTION PACKAGE

BACKGROUND

This section is intended to introduce the reader to various aspects of art that may be related to various aspects of the present invention, which are described and/or claimed below. This discussion is believed to be helpful in providing the reader with background information to facilitate a better understanding of the various aspects of the present invention. Accordingly, it should be understood that these statements are to be read in this light, and not as admissions of prior art.

As will be appreciated, oil and natural gas have a profound effect on modern economies and societies. Indeed, devices and systems that depend on oil and natural gas are ubiquitous. For instance, oil and natural gas are used for fuel in a wide variety of vehicles, such as cars, airplanes, boats, and the like. Further, oil and natural gas are frequently used to heat homes during winter, to generate electricity, and to manufacture an astonishing array of everyday products.

In order to meet the demand for such natural resources, companies often invest significant amounts of time and money in searching for and extracting oil, natural gas, and other subterranean resources from the earth. Particularly, once a desired resource is discovered below the surface of the earth, drilling and production systems are often employed to access and extract the resource. These systems may be located onshore or offshore depending on the location of a desired resource.

A subsea well constructed for producing hydrocarbons consists of a series of concentric drilled and cased bores. The casings typically include sections of threaded and coupled pipes screwed together. The casings are run into the well bore, suspended (landed) in a wellhead attached to the first casing string (referred to as conductor pipe), and cemented in place by circulating cement down the casing and up into the annular area between the casing and well bore.

In the process of drilling and equipping (completing) a subsea well, it is often necessary to suspend production tubing in the subsea wellhead or production tree with a device known as a tubing hanger. The tubing typically consists of sections of threaded and coupled steel pipes similar to casing, but smaller in diameter and usually higher in pressure rating. Unlike casing, the tubing is not cemented in place and therefore can be replaced. In addition to suspending the tubing in the wellhead or in a production tree, the tubing hanger also seals off the annular space between the tubing and the production casing and provides access to down-hole devices such as safety valves, chemical injection ports, down-hole pressure gauges, as well as other devices.

In some drilling and completion procedures, a subsea well is connected to a floating platform on the surface of the sea through a blowout preventer (BOP) stack, a disconnectable lower marine riser package, and a marine riser system. This may include equipment used during tubing hanger installation and/or intervention, such as a subsea test tree (SSTT). For well intervention through the production tree, a different pressure control system is used, which may include a safety package to contain the well, a disconnectable riser package, and a workover riser system. These conventional systems though may require complex and expensive handling and running system, which may occupy a large space on board the vessels that may cause problems with regard to storage of other equipment.

BRIEF DESCRIPTION OF THE DRAWINGS

For a detailed description of embodiments of the subject disclosure, reference will now be made to the accompanying drawings in which.

DETAILED DESCRIPTION

Figure 1:
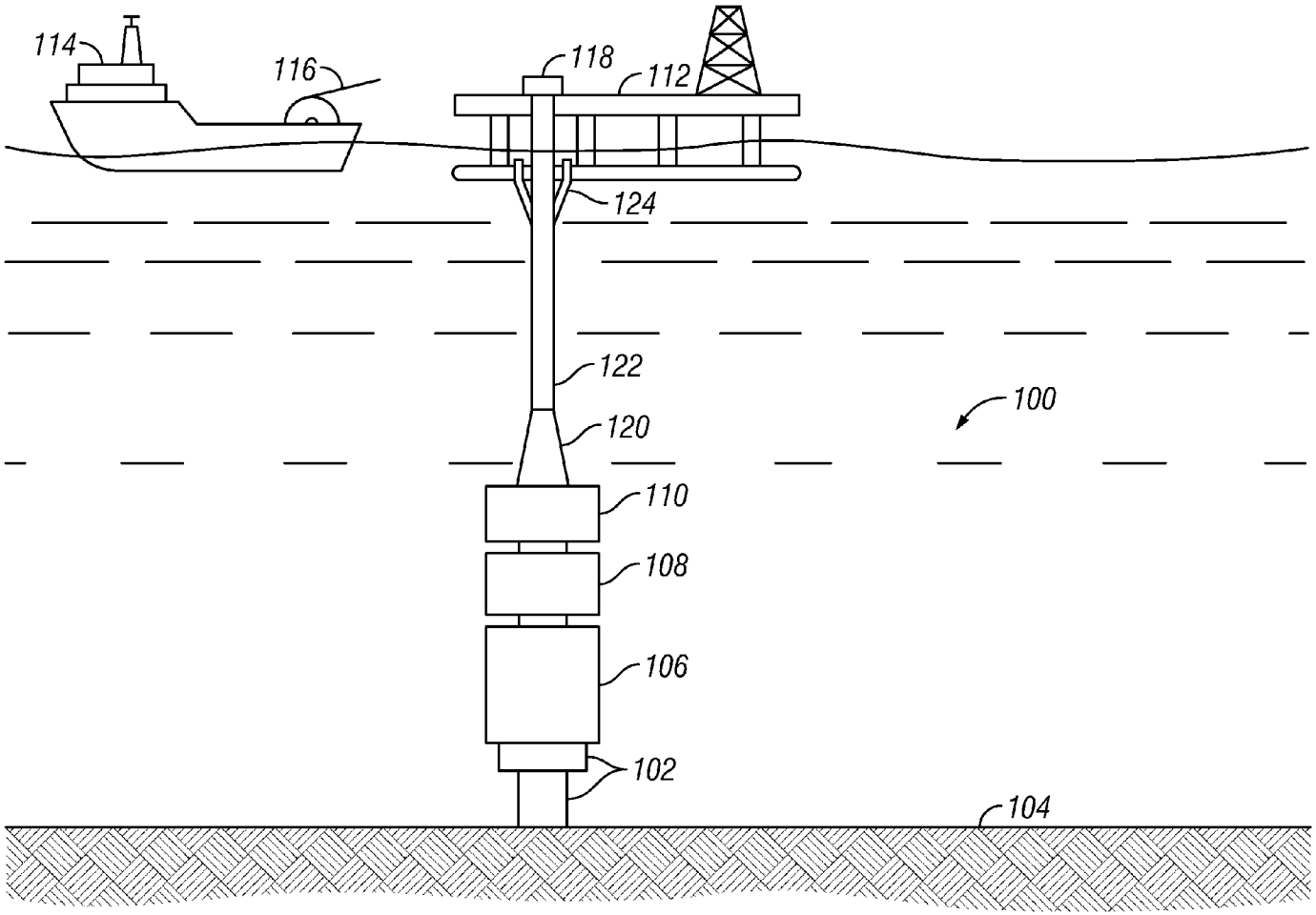
FIG. 1 shows a schematic view of a system for well intervention, installation, and/or workover for a well including a wellhead.

The following discussion is directed to various embodiments of the invention. The drawing figures are not necessarily to scale. Certain features of the embodiments may be shown exaggerated in scale or in somewhat schematic form and some details of conventional elements may not be shown in the interest of clarity and conciseness. The embodiments disclosed should not be interpreted, or otherwise used, as limiting the scope of the disclosure, including the claims. It is to be fully recognized that the different teachings of the embodiments discussed below may be employed separately or in any suitable combination to produce desired results. In addition, one skilled in the art will understand that the following description has broad application, and the discussion of any embodiment is meant only to be an illustration of that embodiment, and not intended to intimate that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but are the same structure or function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . . " Also, the term "couple" or "couples" is intended to mean either an indirect or direct connection. In addition, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis. The use of "top," "bottom," "above," "below," and variations of these terms is made for convenience, but does not require any particular orientation of the components.

Referring now to FIG. 1, a schematic view of a system 100 for well intervention, installation, and/or workover for a well including a wellhead 102 is shown. The well and/or wellhead 102 may extend into the sea floor 104. The wellhead 102 may then include a production tree 106 connected to or installed on the wellhead 102. As such, the production tree may be subsea, and may include conventional (e.g., vertical), horizontal, dual bore, mono bore trees, and/or any other christmas or production tree known in the art. Further, a lower riser package (LRP) 108 may be connected to or installed on the production tree 106, and an emergency disconnect package (EDP) 110 may be connected to or installed on the LRP 108. The LRP 108 may include one or more sealing elements, such as one or more blowout preventers (e.g., ram type blowout preventers, or gate valves capable of cutting) and isolation valves. For example, the LRP 108 may include a shearing ram, a sealing ram, and an isolation valve. In other embodiments, the isolation valve may be replaced by a second shearing ram and a second sealing ram. The EDP 110 may removably connect to the LRP 108, and therefore may include a quick-disconnect connector on its lower end. The EDP 110 may also include one or more sealing elements, such as a blind shearing ram and one or more valves.

The system 100 may further include and/or be deployed from a mobile offshore drilling unit (MODU) 112 or from a workover vessel (WOV) 114, such as to permit well intervention methods using a slickline, e-line, and/or coiled tubing 116. For example, the MODU 112 may include a surface tree 118 that connects to the EDP 110 through a variety of joints and tension systems. In this embodiment, a tapered riser stress joint 120 may be connected to or installed on the EDP 110, in which one or more riser joints 122 may then extend from the tapered riser stress joint 120 towards the surface to the MODU 112. A surface tension joint 124 may then be used to connect the riser joints 122 to the surface tree 118 of the MODU 112. As such, the joints 120, 122, and 124, and in particular the tapered riser stress joint 120 and the surface tension joint 124, may be designed for high fatigue applications, high fracture toughness and large bending moments.

Accordingly, disclosed herein are a lower riser package spool, a riser stress joint, and/or a riser intervention system in accordance with one or more embodiments of the present disclosure. Traditional systems incorporating a lower riser package and/or an emergency disconnect package may require special equipment when deploying and using such equipment offshore. As such, a lower riser spool, a riser stress joint, and/or a riser intervention system in accordance with one or more embodiments of the present disclosure may reduce the overall size and weight of these components while also maintaining important functions of these components.

As such, a lower riser package spool may include a bore with an outer annulus outlet in fluid communication with the bore. A subsea test tree may be landable within the bore of the lower riser package spool, such as landable upon a shoulder projecting or extending into the bore of the lower riser package spool. An intermediate spool is connectable to the lower riser package spool such that the lower riser package spool is in fluid communication with the intermediate spool. Further, upon connecting the intermediate spool to the lower riser package spool, the subsea test tree may be secured within the bore of the lower riser package spool. A riser stress joint is then connectable to the intermediate spool using an actuated connector such that the intermediate spool is in fluid communication with the riser stress joint. In particular, the riser stress joint may include the intermediate spool, in which the riser stress joint and the intermediate spool may each include tapered outer surfaces. In such an embodiment, the riser stress joint may be formed as including a first (e.g., upper) riser stress joint section and a second (e.g., lower) riser stress joint section, each including outer tapered surfaces and connectable to each other. As such, an average outer diameter of the second riser stress joint may be larger than an average outer diameter of the first riser stress joint.

Figure 2:
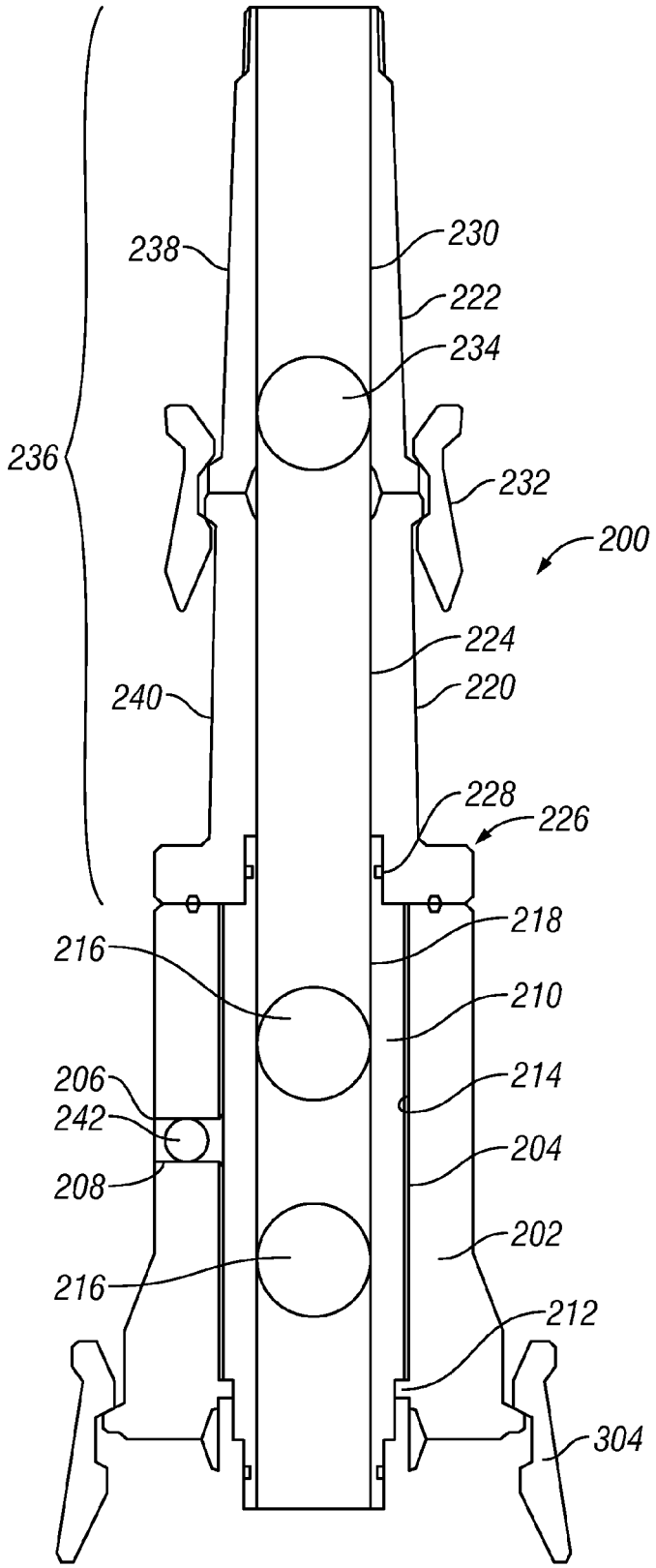
FIG. 2 shows a cross-sectional view of a system in accordance with one or more embodiments of the present disclosure.
Figure 3:
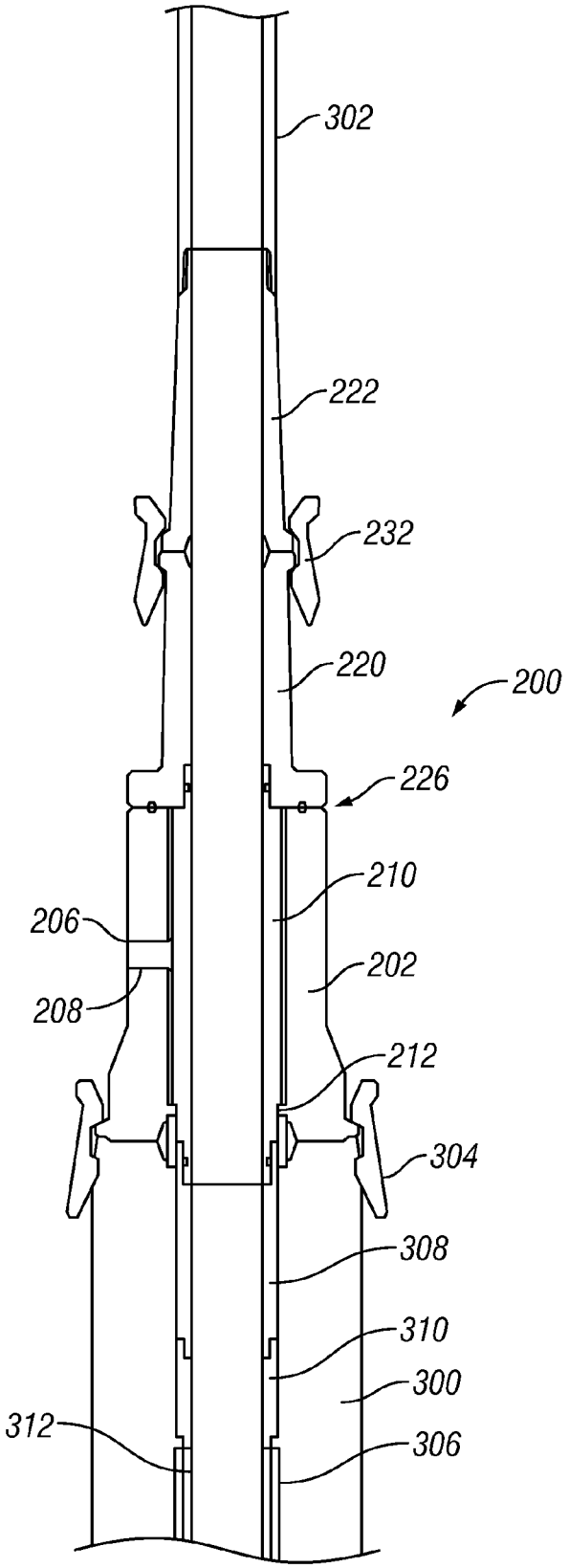
FIG. 3 shows a cross-sectional view of the system connected between a production tree and a riser joint in accordance with one or more embodiments of the present disclosure.

Referring now to FIGS. 2 and 3, multiple views of a subsea system 200, such as an intervention, installation, well testing, and/or workover systems, in accordance with one or more embodiments of the present disclosure are shown. In particular, FIG. 2 shows a cross-sectional view of the system 200, and FIG. 3 shows a cross-sectional view of the system 200 connected between a production tree 300 and a riser joint 302. The system 200 may include a lower riser package spool 202 with a bore 204 formed and/or extending through the lower riser package spool 202. An annulus outlet 206 may be included on an outer surface of the lower riser package spool 202 that is in fluid communication with the bore 204. As shown, an annulus outlet flowpath 208 may be formed within the lower riser package spool 202 that extends between the annulus outlet 206 and the bore 204 such that the annulus outlet 206 and the bore 204 are in fluid communication with each other. One or more valves then may be coupled to and/or included with the lower riser package spool 202, such as to selectively enable fluid flow through the bore 204, the annulus outlet 206, and/or the annulus outlet flowpath 208. For example, a valve 242 may be included within the annulus outlet flowpath 208 to control fluid flow therethrough, and/or a valve may be exterior to the lower riser package spool 202 and coupled to the annulus outlet 206 to control fluid flow therethrough.

The lower riser package spool 202 may be formed or designed such that a subsea test tree 210 is landable, securable, and/or sealable within the lower riser package spool 202. A subsea test tree 210 may be used within intervention, installation, well testing, and/or workover systems. The subsea test tree 210 may include one or more valves 216, such as one above and one below the annulus outlet flowpath 208, to selectively enable fluid flow through a bore 218 of the subsea test tree 210. As such, the lower riser package spool 202 may include a shoulder 212, such as extending or projecting into the bore 204, such that the subsea test tree 210 is landable in the bore 204 and/or upon the shoulder 212 within the lower riser package spool 202.

The subsea test tree 210 may be landable within the lower riser package spool 202 such that an annulus 214 is formed between the bore 204 and the outer surface of the subsea test tree 210. Accordingly, the annulus outlet 206 and the annulus outlet flowpath 208 may be in fluid communication with the annulus 214. Further, the shoulder 212 of the lower riser package spool 202 may be vented, such that even though the subsea test tree 210 is landed upon the shoulder 212, fluid may still be communicated past and through the shoulder 212. For example, one or more vents or ports may be formed through the shoulder 212, in which fluid may be communication through the vents or ports of the shoulder 212 to enable fluid to be communicated with the annulus outlet 206 and the annulus outlet flowpath 208 below the lower riser package spool 202.

Referring still to FIGS. 2 and 3, the system 200 may further include an intermediate spool 220 and a riser stress joint 222. The intermediate spool 220 may be connectable to the lower riser package spool 202 such that the lower riser package spool 202 is in fluid communication with the intermediate spool 220. In particular, the intermediate spool 220 may include a bore 224 extending or formed therethrough, in which the bore 224 of the intermediate spool 220 may be in fluid communication with the bore 204 of the lower riser package spool 202.

The intermediate spool 220 may be connectable to the lower riser package spool 202 such that the subsea test tree 210 is secured within the lower riser package spool 202. For example, when the intermediate spool 220 and the lower riser package spool 202 are connected, the subsea test tree 210 may be secured within the bore 204 of the lower riser package spool 202, such as to prevent axial movement of the subsea test tree 210 within the bore 204 of the lower riser package spool 202. As shown, the intermediate spool 220 may be connectable to the lower riser package spool 202 through a flange connection 226. The flange connection 226 may be used to facilitate securing the subsea test tree 210 within the lower riser package spool 202 and/or to facilitate sealing against the outer surface of the subsea test tree 210. In particular, the subsea test tree 210 may be sealable against the intermediate spool 220, such as through a seal 228 between the subsea test tree 210 and the intermediate spool 220 adjacent the flange connection 226.

The riser stress joint 222 may be connectable to the intermediate spool 220 such that the riser stress joint 222 is in fluid communication with the intermediate spool 220. In particular, the riser stress joint 222 may include a bore 230 extending or formed therethrough, in which the bore 230 of the riser stress joint 222 may be in fluid communication with the bore 224 of the intermediate spool 220.

An actuated connector 232 may be used to connect the riser stress joint 222 and the intermediate spool 220. The actuated connector 232 may be a quick-disconnect connector. For example, the actuated connector 232 may be used to quickly disconnect the riser stress joint 222 and the intermediate spool 220, such as in times of an emergency (e.g., weather) when a surface rig or vessel needs to be disconnected from a well. Accordingly, the actuated connector 232 may be actuated to disconnect the riser stress joint 222 from the intermediate spool 220. An actuated connector in accordance with the present disclosure may be hydraulically actuated, such as a hydraulically actuated collet connector, may be electrically actuated, may be mechanically actuated, and/or may be any other quick-disconnect connector known in the art.

As shown, a riser retainer valve 234 may be included within the system 200, such as to selectively enable fluid flow through the bore 224 of the intermediate spool 220 and/or the bore 230 of the riser stress joint 222. In particular, in this embodiment, the riser retainer valve 234 may be positioned within the bore 230 of the riser stress joint 222 and/or above the connection between the riser stress joint 222 and the intermediate spool 220. In such an embodiment, this may enable the riser retainer valve 234 to be closed before disconnecting the riser stress joint 222 from the intermediate spool 220, thereby preventing any fluid contained within and/or above the riser stress joint 222 from escaping the system 200 into the sea.

A riser stress joint in accordance with the present disclosure may include and/or be formed as multiple portions or sections. For example, in one or more embodiments, the riser stress joint 222 and the intermediate spool 220 may be used together to form a multi-piece riser stress joint 236 that includes two or more sections. In such an embodiment, the riser stress joint 222 may include a tapered outer surface 238 and may be used as a first (e.g., upper) riser stress joint section, and the intermediate spool 220 may include a tapered outer surface 240 and may be used as a second (e.g., lower) riser stress joint section. As such, the average outer diameter of the second riser stress joint (e.g., the intermediate spool 220) may be larger than an average outer diameter of the first riser stress joint (e.g., the riser stress joint 222).

In one or more embodiments, when referring to components within the present disclosure being connectable or connected to each other, the components may be directly connectable or connected to each other. As used herein, "directly connectable" and/or "directly connected" may refer to two components that may be connected to each other with no or minimal components in between the connected components. As such, "directly connectable" and/or "directly connected" may refer to components that, when connected to each other, may be in direct contact with each other, and/or may be in direct contact with another component that may be in direct contact with each other.

Accordingly, with reference to FIGS. 2 and 3, the intermediate spool 220 may be directly connectable to the lower riser package spool 202, and/or the riser stress joint 222 may be directly connectable to the intermediate spool 220. As shown the intermediate spool 220 may be directly connectable to the lower riser package spool 202 through the flange connection 226, in which bolts, screws, nuts, and/or other securing mechanisms may be used to connect the intermediate spool 220 and the lower riser package spool 202 through the flange connection 226. One or more seals may be used to seal the connection between the intermediate spool 220 and the lower riser package spool 202, but otherwise, the intermediate spool 220 and the lower riser package spool 202 may be in direct contact with each other, and/or in direct contact with a component (e.g., a seal) that is then in direct contact with the intermediate spool 220 and the lower riser package spool 202.

Further, the riser stress joint 222 may be directly connectable to the intermediate spool 220 through the actuated connector 232. One or more seals may be used to seal the connection between the riser stress joint 222 and the intermediate spool 220. The riser stress joint 222 and the intermediate spool 220 may then be in direct contact with each other, and/or in direct contact with a component (e.g., the actuated connector 232 and/or a seal) that is then in direct contact with the riser stress joint 222 and the intermediate spool 220.

Referring now to FIG. 3, and as discussed above, the system 200 may be included and/or connected between the production tree 300 and the riser joint 302 (e.g., of a riser string). In particular, the lower riser package spool 202 may be connectable to the production tree 300 such that the lower riser package spool 202 and the production tree 300 are in fluid communication with each other. In such an embodiment, the subsea test tree 310 may be sealable against the production tree 300. As shown, an actuated connector 304 may be used to connect the lower riser package spool 202 and the production tree 300. In such an embodiment, the bore 204 of the lower riser package spool 202 may be in fluid communication with a bore 306 of the production tree 300. Further, as the shoulder 212 of the lower riser package spool 202 may be vented, the annulus outlet 206 and the annulus outlet flowpath 208 may be in fluid communication with the bore 306 of the production tree 300 and/or an annulus formed within the bore 306 of the production tree 300. Accordingly, as discussed herein, multiple components of the present disclosure may include a bore, such as a lower riser package spool, an intermediate spool, a riser stress joint, and/or production tree. As such, as these components may include one or more other components and/or tubulars may be inserted and/or positioned within the bore of these components, the bore may also be used to define an annulus within these components, as an annulus may refer to any void and/or annular space formed within a bore and between multiple components. For example, as the lower riser package spool 202 includes the bore 204 with the subsea test tree 210 positioned within the bore 204 of the lower riser package spool 202, an annulus may be formed between the outer surface of the subsea test tree 210 and the inner surface of the lower riser package spool 202.

The subsea test tree 310 may be connectable to a tubing hanger running tool 308. As such, the tubing hanger running tool 308 may be connectable to a tubing hanger 310 (such as within a horizontal production tree), in which the tubing hanger running tool 308 may be used to run and deploy a tubing hanger 310 into the production tree 300. The tubing hanger 310 may then be used to support a tubing string 312 (e.g., production string) therefrom, in which the tubing string 312 may extend into the well. The tubing hanger running tool 308 may also be used to connect the subsea test tree 210 to the production tree 300 (such as within a vertical, mono bore production tree). Further, the riser joint 302 may be connectable to the riser stress joint 222 (e.g., the first riser stress joint section), in which the riser joint 302 may be part of a casing string that extends up to rig or vessel at the surface at sea level.

In one or more embodiments, an umbilical, wire, line, cable, or the like, may be run or deployed from a vessel or rig at the surface to control the actuated connector 232. The umbilical may be deployed interior or exterior to the casing string and then connected to the actuated connector 232 to control the actuated connector 232. If the umbilical is run interior to the casing string, a port or aperture may be formed through the riser stress joint 222 and/or the intermediate spool 220 to communicate the umbilical with the actuated connector 232. Further, an umbilical may be used to control the actuated connector 304. In one or more embodiments, an umbilical may be run or deployed from a vessel or rig at the surface to control the actuated connector 304, and/or a jumper may be run from the actuated connector 232 to the actuated connector 304 to control the actuated connector 304.

Further, in one or more embodiments, an umbilical (e.g., separate from the umbilical for the actuated connector 232) may be used to control and be in fluid communication with the annulus outlet 206 of the lower riser package spool 202. This may enable pressure tests, pressure monitoring and/or venting, and the like to be used to control and operate the lower riser package spool 202 separate from the actuated connectors 232 and/or 304.

In one or more embodiments, when assembling the system 200, the subsea test tree 210 may be positioned and sealable within the lower riser package spool 202. The intermediate spool 220 may then be connected to the lower riser package spool 202, such as through the flange connection 226, to secure the subsea test tree 210 within the lower riser package spool 202. This may all be performed when at the surface, such as on the rig or vessel, and not subsea. The lower riser package spool 202 may then be connected to the production tree 300 when subsea. The riser stress joint 222 may be connected to the intermediate spool 220 at the surface and subsequent riser joints 302 may be connected and made-up to the riser stress joint 222 as the equipment is installed subsea.

As discussed above, a lower riser package spool, a riser stress joint, and/or a riser intervention system in accordance with one or more embodiments of the present disclosure may be able to reduce the overall size and weight of these components while also maintaining important functions of these components. For example, previously, large heavy moving equipment, such as cranes, were necessary to move and assemble emergency disconnect packages and lower riser packages. An embodiment of the present disclosure may enable these components to be smaller such that space is saved from the components of the system, in addition to saving space from eliminating the need for large heavy moving equipment.

Although the present invention has been described with respect to specific details, it is not intended that such details should be regarded as limitations on the scope of the invention, except to the extent that they are included in the accompanying claims.

What is claimed is:

1. A riser intervention system for use with a subsea test tree, the system comprising:

a lower riser package spool comprising:

a bore; and a shoulder projecting into the bore, the shoulder configured to receive a direct landing of the subsea test tree thereon;

an intermediate spool connectable to the lower riser package spool such that the lower riser package spool is in fluid communication with the intermediate spool; and a riser stress joint releasably connectable to the intermediate spool such that the intermediate spool is in fluid communication with the riser stress joint.

2. The system of claim 1, wherein the riser stress joint is releasably connectable to the intermediate spool using a connector, and wherein the connector comprises a hydraulically actuated collet connector.

3. The system of claim 1, further comprising a multi-piece riser stress joint comprising the riser stress joint and the intermediate spool such that the riser stress joint and the intermediate spool each comprise tapered outer surfaces.

4. The system of claim 1, wherein the intermediate spool is connectable to the lower riser package spool through a flange connection.

5. The system of claim 1, wherein the subsea test tree is sealable against the intermediate spool when the subsea test tree is secured within the lower riser package spool.

6. The system of claim 1, wherein a riser retainer valve is positioned, at least partially, within the riser stress joint such that the riser retainer valve is in fluid communication with the subsea test tree to selectively enable fluid flow to the subsea test tree.

7. The system of claim 1, wherein the lower riser package spool comprises an annulus outlet on an outer surface of the lower riser package spool in fluid communication with an annulus of a production tree, wherein the annulus outlet is in fluid communication with an annulus of the lower riser package spool through an annulus outlet flowpath, and wherein an annulus valve selectively enables fluid flow through the annulus outlet flowpath.

8. The system of claim 1, wherein the intermediate spool is directly connectable to the lower riser package spool, and wherein the riser stress joint is directly connectable to the intermediate spool.

9. The system of claim 1, wherein the lower riser package spool is connectable to a production tree such that the production tree is in fluid communication with the lower riser package spool.

10. The system of claim 9, wherein the shoulder comprises a vent such that an annulus of the lower riser package spool is in fluid communication with an annulus of the production tree.

11. The system of claim 9, wherein the subsea test tree is sealable against the production tree when the subsea test tree is secured within the lower riser package spool and the lower riser package spool is connected to the production tree.

12. The system of claim 1, wherein the subsea test tree is connectable to a tubing hanger running tool, wherein the tubing hanger running tool is positionable within a production tree, and wherein the riser stress joint is connectable to a riser joint.

13. A riser intervention system for use with a subsea test tree, the system comprising:

a lower riser package spool comprising a bore and a shoulder projecting into the bore, wherein the shoulder is configured to receive a direct landing of the subsea test tree thereon; and a riser stress joint connectable to the lower riser package spool, the riser stress joint comprising:

a first riser stress joint section comprising an outer tapered surface; and a second riser stress joint section comprising an outer tapered surface and connectable to the first riser stress joint section.

14. The system of claim 13, wherein the second riser stress joint section is connectable between the first riser stress joint section and the lower riser package spool, and wherein an average outer diameter of the second riser stress joint section is larger than an average outer diameter of the first riser stress joint section.

15. The system of claim 13, wherein the lower riser package spool comprises an outer annulus outlet, and wherein an annulus valve is in fluid communication with the outer annulus outlet to selectively control fluid flow through the outer annulus outlet.

16. The system of claim 13, wherein the first riser stress joint section and the second riser stress joint section are releasably connectable through a connector, and wherein the riser stress joint and the lower riser package spool are connectable through a flange connection.

17. The system of claim 13, wherein the lower riser package spool is connectable to a production tree.

18. The system of claim 17, wherein the subsea test tree is connectable to a tubing hanger miming tool, wherein the riser stress joint is connectable to a riser joint, and wherein the subsea test tree is sealable against the riser stress joint when the subsea test tree is secured within the lower riser package spool.

19. The system of claim 17, wherein the riser stress joint is directly connectable to the lower riser package spool, wherein the first riser stress joint section is directly connectable to the second riser stress joint section, and wherein the lower riser package spool is directly connectable to the production tree.

20. The system of claim 13, wherein the shoulder comprises a vent such that, when the subsea test tree is landed upon the shoulder, fluid communication is enabled past the shoulder.

* * * * *